US006305100B1

(12) United States Patent
Komarnycky et al.

(10) Patent No.: US 6,305,100 B1
(45) Date of Patent: Oct. 23, 2001

(54) SHOE VENTILATION

(76) Inventors: Eugene Komarnycky, 96 St. Mark's Pl., New York, NY (US) 10009; Adrian Pysariwsky, 297 Lakeview Ave., Clifton, NJ (US) 07011

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/804,888

(22) Filed: Feb. 24, 1997

Related U.S. Application Data

(63) Continuation of application No. 08/485,722, filed on Jun. 7, 1995, now abandoned.

(51) Int. Cl.[7] ..... A43B 7/06; A43B 13/28; A43B 13/20; A43B 21/26

(52) U.S. Cl. ..... 36/3 R; 36/3 B; 36/29; 36/27; 36/35 B

(58) Field of Search ..... 36/3 R, 3 B, 28, 36/29, 27, 25 R, 30 R, 32 R, 35 B

(56) References Cited

U.S. PATENT DOCUMENTS

| | | | | |
|---|---|---|---|---|
| 1,932,557 | | 10/1933 | Meucci | 36/3 R |
| 2,098,412 | | 11/1937 | Bovay | 36/3 R |
| 2,720,041 | * | 10/1955 | Kastar | 36/3 B |
| 2,751,692 | * | 6/1956 | Cortina | 36/3 B |
| 2,983,056 | | 5/1961 | Murawski | 36/29 |
| 3,012,342 | | 12/1961 | Ramirez | 36/3 R |
| 3,050,875 | * | 8/1962 | Robbins | 36/3 B |
| 3,256,621 | | 6/1966 | Linton | 36/3 R |
| 3,791,051 | * | 2/1974 | Kamimura | 36/3 B |
| 4,223,455 | | 9/1980 | Vermeulen | 36/29 |
| 4,438,573 | * | 3/1984 | McBarron | 36/3 B |
| 4,445,284 | | 5/1984 | Sakutori | 36/3 B |
| 4,462,171 | * | 7/1984 | Whispell | 36/3 B |
| 4,494,322 | | 1/1985 | Klagmann | 36/28 |
| 4,499,672 | | 2/1985 | Kim | 36/3 B |
| 4,617,745 | * | 10/1986 | Batra | 36/3 B |
| 4,619,055 | | 10/1986 | Davidson | 36/28 |
| 4,654,982 | | 4/1987 | Lee | 36/3 R |
| 4,776,109 | * | 10/1988 | Sacre | 36/3 B |
| 4,782,603 | | 11/1988 | Brown | 36/29 |
| 4,813,160 | | 3/1989 | Kuzentz | 36/3 R |
| 4,837,948 | | 6/1989 | Cho | 36/3 A |

(List continued on next page.)

FOREIGN PATENT DOCUMENTS

| | | | | |
|---|---|---|---|---|
| 294671 | | 11/1953 | (CH) . | |
| 3232019 | * | 3/1984 | (DE) | 36/3 B |
| 4118911 | * | 12/1992 | (DE) | 36/3 B |
| 1027198 | | 5/1953 | (FR) . | |
| 2097997 | | 11/1992 | (GB) . | |
| 506875 | | 12/1954 | (IT) . | |
| 566195 | | 8/1957 | (IT) . | |

* cited by examiner

*Primary Examiner*—Paul T. Sewell
*Assistant Examiner*—Anthony Stashick
(74) *Attorney, Agent, or Firm*—Morgan & Finnegan, LLP

(57) ABSTRACT

A shoe which facilitates ventilation between the inner area of the shoe and its surrounding environment. An air cavity allowing foot heat and moisture to escape the immediate foot area and exhaust into free open space is used. A dual-layer sole system which is integrated in a manner to form an air cavity therebetween is also utilized. A series of perforations and/or cutouts are used to facilitate foot-air and moisture flow. A plurality of ventilation ports are used to facilitate bi-directional air exchange and circulation. Two anvil-shaped supports at the ball and foot area may serve as a framework to preserve the shape of the open-air cavity.

22 Claims, 10 Drawing Sheets

U.S. PATENT DOCUMENTS

| | | | |
|---|---|---|---|
| 4,852,274 | 8/1989 | Wilson | 36/29 |
| 4,888,887 | 12/1989 | Solow | 36/3 R |
| 4,894,932 | 1/1990 | Harada et al. | 36/3 R |
| 4,912,858 | 4/1990 | Mochizuki | 36/3 B |
| 4,914,836 | 4/1990 | Horovitz | 36/28 |
| 4,934,071 | 6/1990 | Virgini | 36/29 |
| 4,939,851 | 7/1990 | Miller | 36/3 B |
| 4,942,677 | 7/1990 | Flemming et al. | 36/27 |
| 5,035,068 | 7/1991 | Biasi | 36/3 R |
| 5,042,175 | 8/1991 | Ronen et al. | 36/28 |
| 5,044,096 | 9/1991 | Polegato | 36/3 R |
| 5,086,572 | 2/1992 | Lee | 36/3 R |
| 5,138,775 | 8/1992 | Chu | 36/3 B |
| 5,220,737 * | 6/1993 | Edington | 36/29 X |
| 5,224,277 | 7/1993 | Sang Do | 36/27 |
| 5,224,280 | 7/1993 | Preman et al. | 36/30 R |
| 5,233,767 | 8/1993 | Kramer | 36/28 |
| 5,279,051 | 1/1994 | Whatley | 36/25 R |
| 5,299,368 | 4/1994 | Liu | 36/3 B |
| 5,337,492 | 8/1994 | Anderié et al. | 36/28 |
| 5,400,523 * | 3/1995 | Sessa | 36/3 B |
| 5,461,800 * | 10/1995 | Luthi et al. | 36/28 |
| 5,595,002 * | 1/1997 | Slepian et al. | 36/27 |

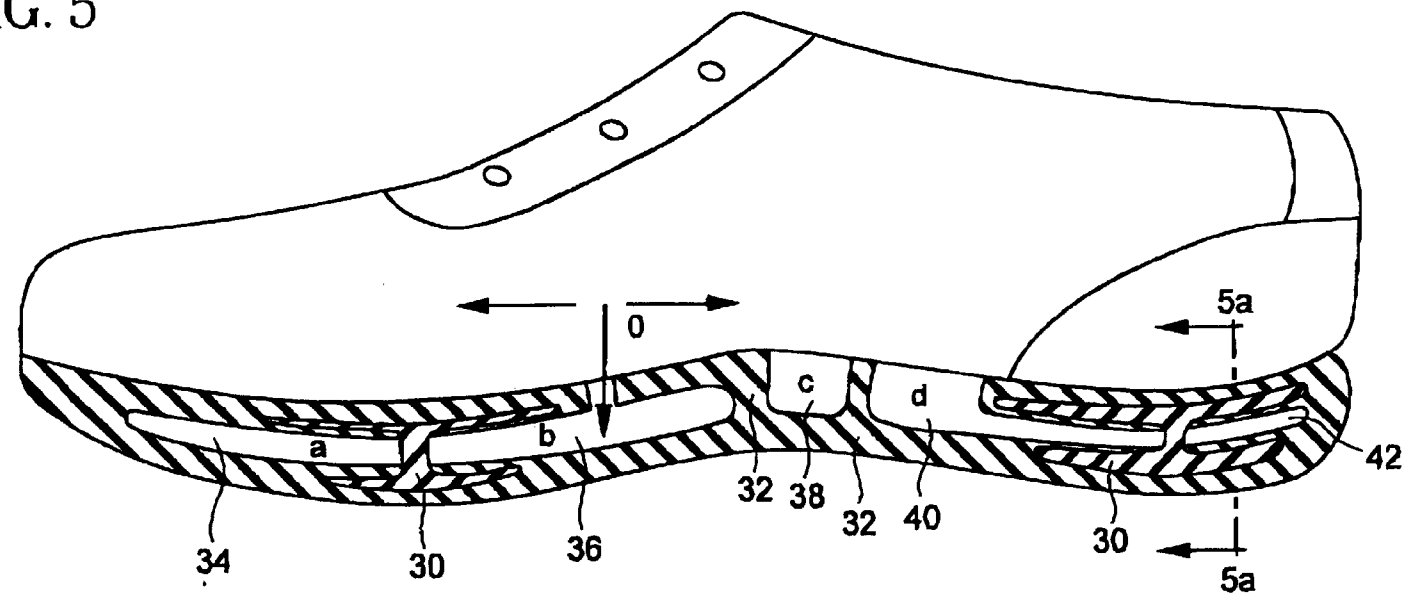
FIG. 5
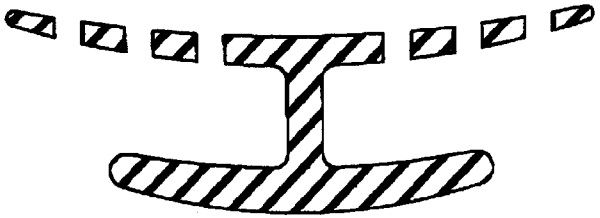
FIG. 5B LONG-AXIS
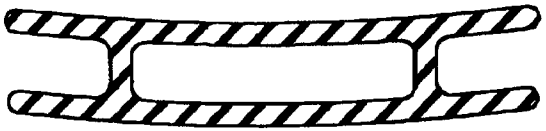
FIG. 5A TRANSVERSE

SHOE VENTILATION

This is a continuation of application Ser. No. 08/485,722, filed on Jun. 7, 1995 abandoned.

BACKGROUND-FIELD OF INVENTION

This invention relates, in general, to improvements in shoe ventilation and more particularly to shoes which allow for ventilation between the inner area of the shoe and its surrounding environment.

BACKGROUND-DESCRIPTION OF RELATED ART

Currently available footwear provides little or no provision to expel foot heat and moisture from the immediate foot area. Moisture and heat tend to remain trapped in the interior toe and heel areas of conventional shoes. The foot is prone to this buildup of heat and moisture, leading to discomfort, odor, and possible foot disease.

In the past, various means of ventilation have been utilized. They range from simple modifications to the shoe upper, to complex forced air mechanisms embedded in the sole area of the shoe. These various attempts have had limited success in ventilating the entire interior of the shoe along with additional disadvantages referenced below;

U.S. Pat. No. 4,888,887 to Solow is directed to one-way valves that promote limiting one-way airflow and rely on foot pressure for operation; consequently, ventilation is minimal when a person is sitting, or standing in one position.

U.S. Pat. No. 4,813,160 to Kuznetz is directed to an arrangement which also utilizes foot pressure to discharge moist foot air. This ventilation system design necessitates the use of air-restrictors at the ventilation port promoting one-way airflow. Additionally, the tube-shaped passageways through which ventilation takes place is narrow and inefficient.

U.S. Pat. No. 4,654,982 to Lee is directed to an arrangement which utilizes spring-type one-way valves to promote air flow. These valves are prone to clogging moisture and dirt-buildup and subsequent malfunction.

U.S. Pat. No. 5,224,277 to Sang Do is directed to a waterproof system employing buoyancy plates and intricate air passageways eventually leading to one ventilation port in the heel area. This system is complex and difficult to manufacture and promotes inefficient ventilation.

U.S. Pat. No. 5,086,572 to Lee is also directed to a complex system employing intricate ventilation passageways employing spring-actuated valves with questionable reliability.

All of the ventilated footwear of the related art heretofore known suffer from a number of disadvantages.

a) They utilize intricate and minimal volume ventilation passageways as the communication medium between the interior and exterior of the shoe, which result in decreased ventilation efficiency.

b) They utilize one-way valves that promote one-way ventilation flow within the shoe, which result in inefficient ventilation between the interior of the shoe and the outside environment.

c) They utilize bladder-pumping mechanisms actuated by foot pressure that discharge air into the interior of the shoe. This system is ineffective when sitting or standing on one spot.

d) They utilize mechanical valves, springs, and plates that are prone to malfunction.

e) They are difficult to clean and maintain for optimum ventilation efficiency.

f) They utilize a ventilation system that is complex and difficult to manufacture.

g) They provide no effective barrier against street penetrating heat.

OBJECTS AND ADVANTAGES

Accordingly, the objects and advantages of the present invention include, among others:

a) To provide a shoe with a large-volume air cavity acting as the communicating medium between the interior and exterior of the shoe, resulting in superior, efficient ventilation flow;

b) To provide ventilation ports with simultaneous two-way ventilation communication between the interior and exterior of the shoe;

c) To provide efficient shoe ventilation whether walking, standing, or sitting;

d) To provide reliable shoe ventilation;

e) To provide a shoe where the ventilation system is easily maintained;

f) To provide a shoe with a ventilation system that is easily manufactured.

g) To provide a shoe that effectively stops street penetrating heat from reaching the shoe interior.

Numerous other objects and advantages will become apparent from a review of the following detailed description of the preferred embodiments of the present invention.

SUMMARY OF THE INVENTION

In accordance with the aforementioned, the present invention is directed to an article of footwear having a ventilated sole system, including a dual-layer sole system having an inner sole and an outer sole, the inner sole and the outer sole being integrated together and forming an air-cavity therebetween, the dual-layer sole system including a plurality of bi-directional ventilation ports, the bi-directional ventilation ports extending from the air-cavity to an area outside the article of footwear, the dual-layer sole system further comprising a plurality of conduits extending from a surface on the inner sole which receives a user's foot through the inner sole into the air cavity.

BRIEF DESCRIPTION OF DRAWINGS

FIG. 5 shows a variation of FIG. 4 utilizing anvil shaped supports.

FIG. 5*a* shows a transverse view of an anvil-shaped support member along lines 5*a*—5*a* of FIG. 5.

FIG. 5*b* shows a view along a long axis of an anvil-shaped support member of FIG. 5.

DETAILED DESCRIPTION OF THE PREFERRED EMBODIMENTS OF THE PRESENT INVENTION

Figure 1:
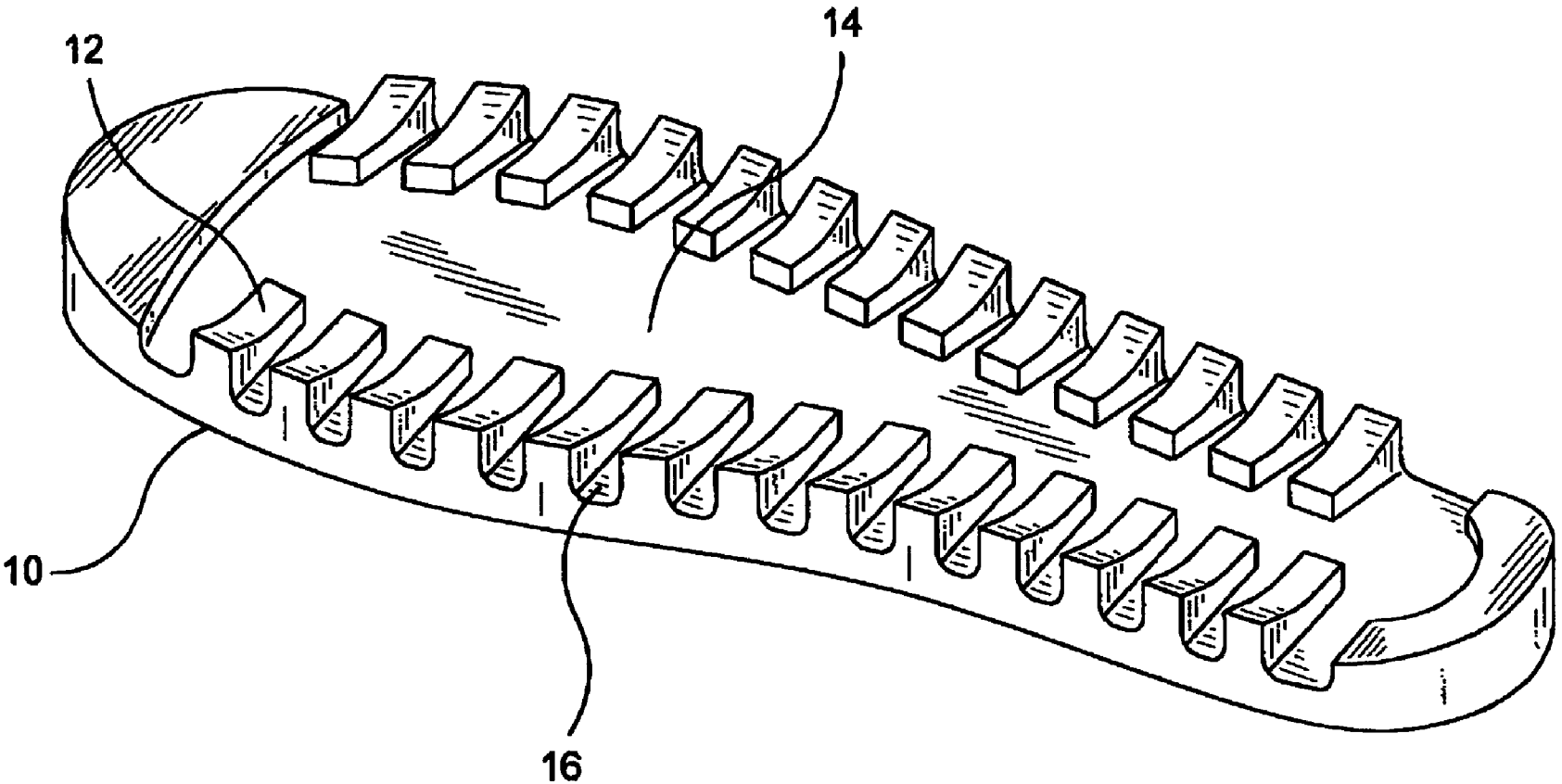
FIG. 1 shows an outer sole with concave ridges outlining its periphery.

This invention provides a unique approach to the ventilation of a shoe interior and the subsequent exhaust of foot heat and moisture. The invention principle utilizes an efficient air cavity allowing foot heat and moisture to escape the immediate foot area and exhaust into free open space. This is achieved through a unique sole design, employing a dual-layer sole system. The layers of this dual-layer sole are integrated in a manner which allows an air cavity area to exist between them. This air cavity area acts as an interfacing medium between the inner foot area and free open space outside the immediate shoe area.

Foot-air and moisture flow is achieved by employing a series of perforations and/or cutouts throughout the inner primary-layer sole. These perforations extend through the surface of this inner sole immediately into an air cavity area. In turn, this air cavity area extends ultimately into free open space outside the shoe via multiple ventilation ports. This system provides an efficient direct path for foot heat and moisture exhaustion. In addition to outward direction of foot heat/moisture elimination, the air cavity/inner sole design facilitates a bi-directional air exchange and circulation. This promotes breathability-action to the inner foot area.

The inner sole is integrated with the outer sole through a number of ridges constructed in a manner outlining the air cavity area. The thickness and height of these ridges vary with shoe size and the intended shoe application. These outer sole ridges provide structural stability to the overlaying inner sole while preserving the breathability-action of the air cavity/inner sole area. These ridges/supports are fused to the under-side of the inner sole in a manner maintaining perforation continuity into the air cavity area. In addition to providing structural support, these outer sole ridges outline multiple ventilation ports along the periphery of the outer sole.

This invention also provides relief from the environment while standing in one place. The air cavity area acts as a barrier to the conduction of heat or cold emanating from the ground surface (sidewalk temperature). The foot comes in contact only with the small ridge/column contact surface area. The traditional sole exposes the entire foot-bottom area to sidewalk temperature.

The breathability-action and ventilation of the inner foot area is further enhanced through the walking process itself, providing a "pumping-action" as weight is transferred from the heel to the toe of the foot. This "pumping-action" is the result of foot pressure being applied and released directly at the perforated inner sole. This application of alternating positive and negative pressure continually promotes a circulating air exchange between the inner foot area and free open space.

The design of the outer sole system varies with the desired foot stability, walking sensation, air ventilation characteristics, and intended shoe application. Athletic or competition shoes employ an outer sole emphasizing stability and rigidity. Dress and casual shoes for men and women utilize an outer sole geared towards comfort, ventilation performance, and reduced bulkiness.

This invention is easily modified for use in cold weather. Foot moisture is a major cause for "cold feet" discomfort. Sole material, perforation size, spacing, and the air cavity flow mechanism are easily revised for optimal cold weather moisture exhaustion/performance. Porous or mesh-like materials easily substitute the perforated inner sole. Rainy weather shoes employ materials which promote air over liquid transpiration.

In accordance with the aforementioned, a first embodiment of an outer sole of the present invention is illustrated in FIG. 1. An outer sole 10 is shown with ridges 12 outlining the outer boundary of the outer sole. The top portion of the ridge is concave, sloping downward toward the middle of the outer sole. This concave shape conforms to the outline of the foot. Ridges exposed to greater foot pressure are both thicker and extend further inward. The air cavity 14 exists within the area bounded by the ridges and is a continuous open space. This air cavity 14 is also bounded by a toe portion 15*a* and a heel portion 15*b*. This air cavity interfaces with the outside environment via bi-directional ventilation ports 16 defined by the outer sole ridges.

Figure 1A:
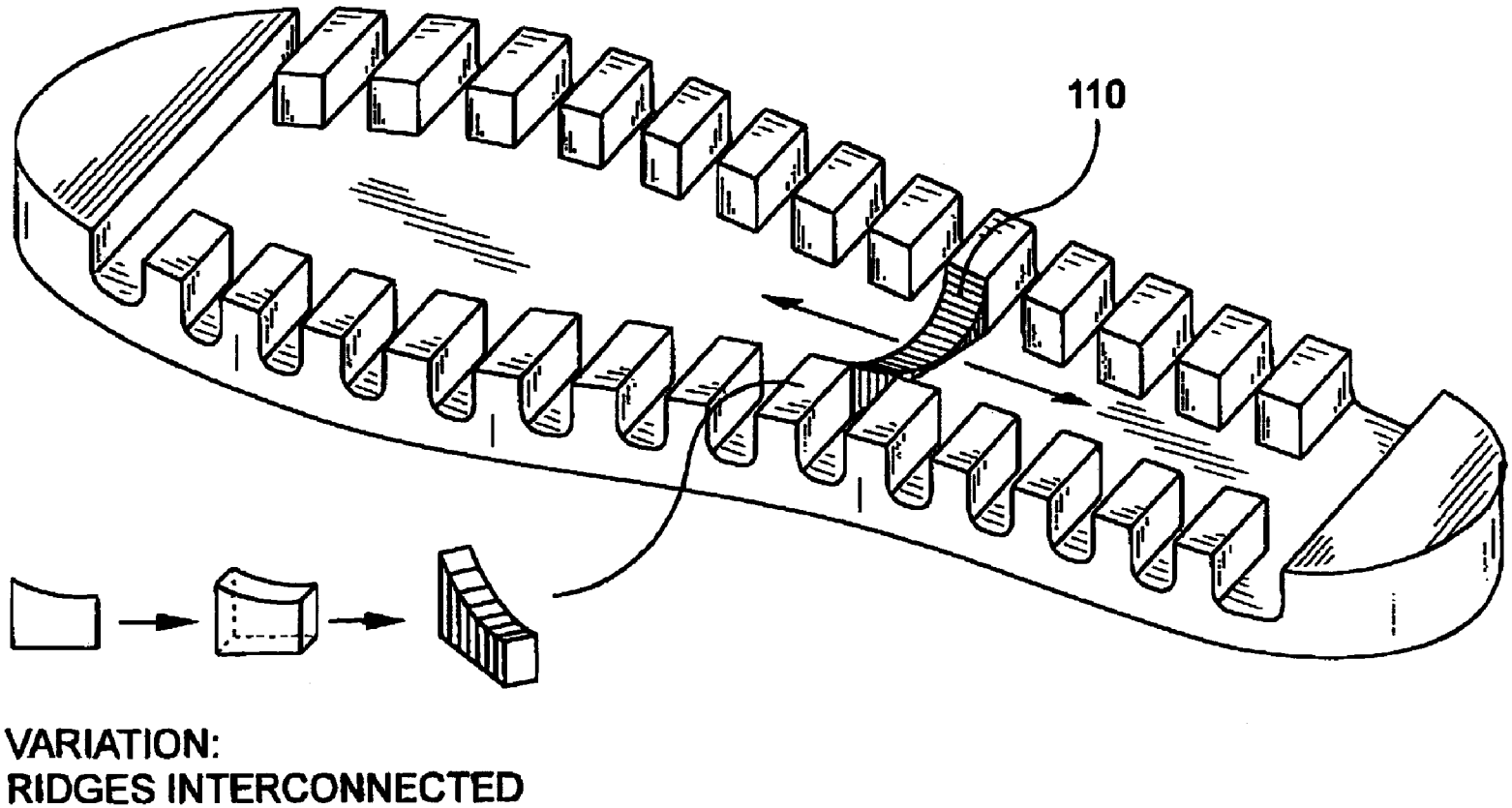
FIG. 1*a* shows an outer sole with a reinforcing member interconnecting two opposite concave ridges in accordance with another embodiment of the present invention.

With reference to FIG. 1*a*, a reinforcing member 110 is shown as it interconnects two opposite ridges. Although only one reinforcing member is shown, it is to be understood that a plurality of such reinforcing members may be used, each of these reinforcing members interconnecting two opposite ridges. This reinforcing member 110 further stabilizes the shoe structure while preserving the air cavity.

Figure 2:
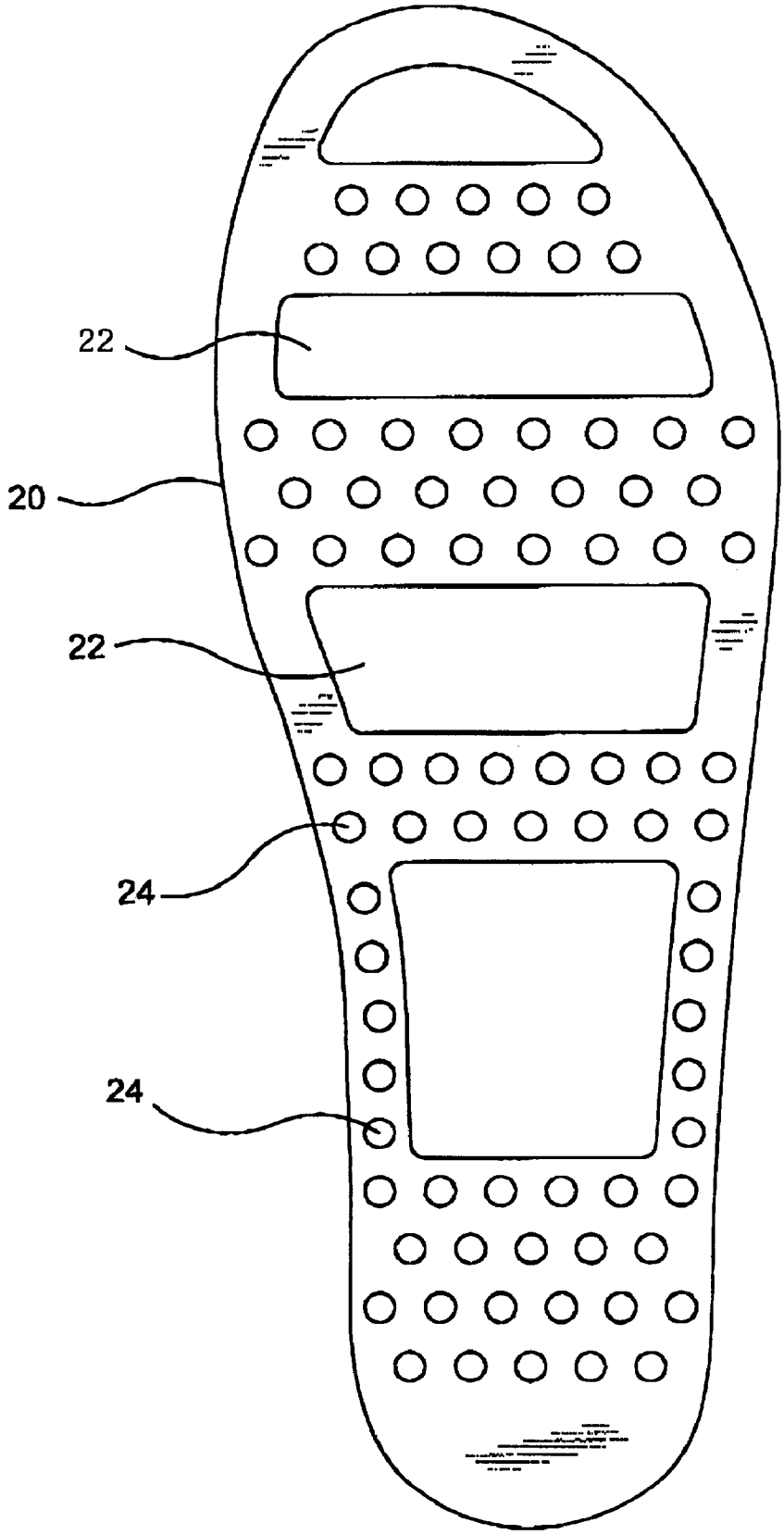
FIG. 2 shows an inner sole with a plurality of perforations and cutouts.

FIG. 2 illustrates an inner sole 20. This inner sole is cut-out 22 geometrically in areas subject to little or no foot pressure. The remaining portion of the inner sole is perforated continuously. This inner sole is made of a semi-rigid material that keeps its structural shape and integrity under foot pressure, but is flexible yet non-stretchable.

Figure 3:
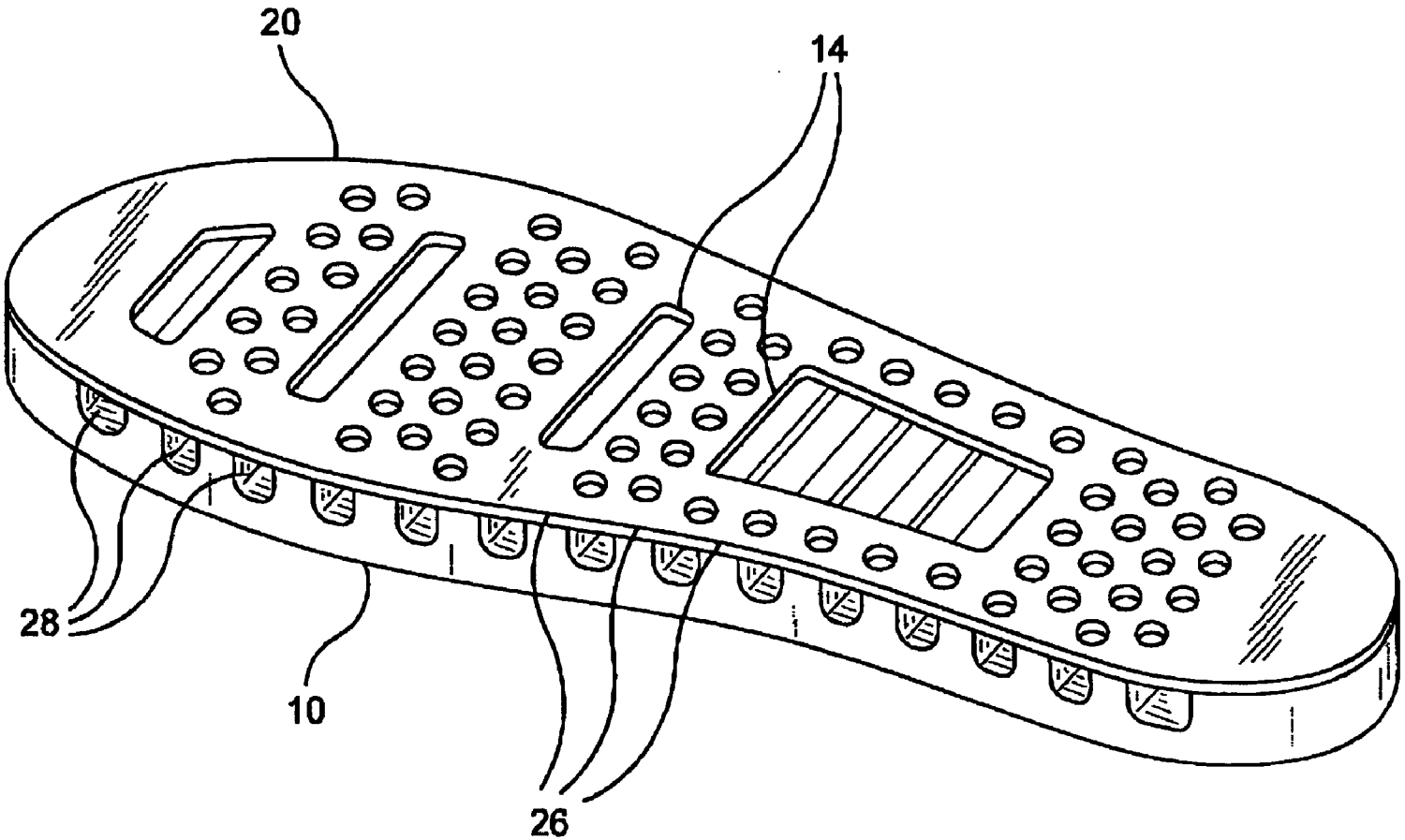
FIG. 3 shows the inner sole of FIG. 2 overlaying and fused to the outer sole of FIG. 1.

FIG. 3 illustrates the inner sole of FIG. 2 overlaying the outer sole of FIG. 1. The inner sole is fused in areas 26 to the concave ridges of the outer sole in a manner providing structural stability, yet preserving the bi-directional ventilation and circulation effect of the underlying continuous air cavity area 14. The cutouts 22 and perforations 24 of the inner sole act as conduits to provide a direct path for foot heat/moisture and air circulation throughout the inner foot area and the corresponding air cavity area. The air cavity area in turn communicates with the outside environment via ventilation ports 28 outlining the periphery of the outer sole.

Figure 4:
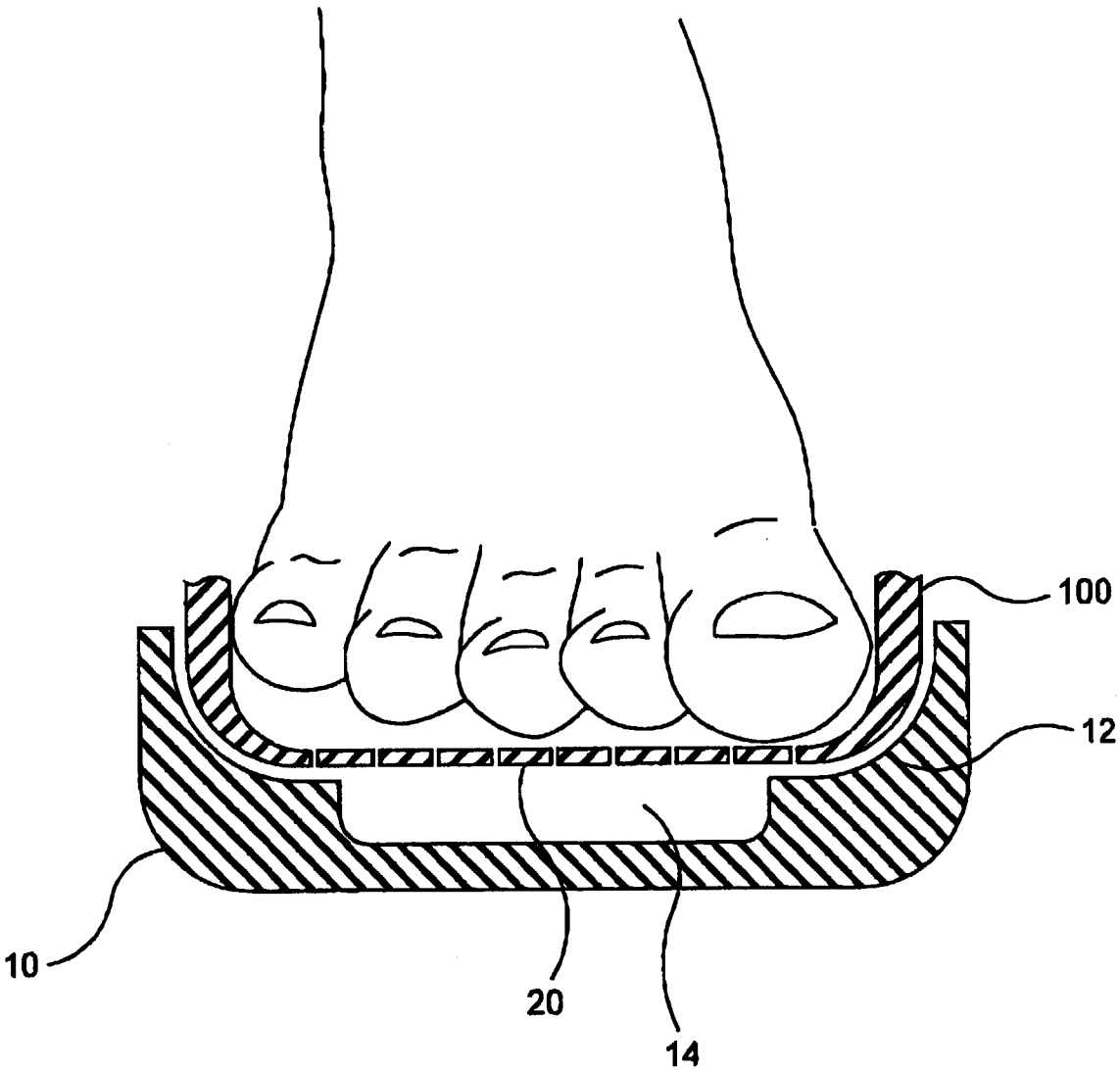
FIG. 4 shows a frontal view of a shoe upper integrated with the inner sole of FIG. 2 and the outer sole of FIG. 1.

FIG. 4 illustrates a shoe upper integrated with the inner and outer sole of FIG. 3. The foot inside the shoe is supported by the structural combination of the shoe upper along with inner and outer sole. The center of the foot is in direct contact with the inner sole while the foot's periphery "sits" in the outlined concave-shaped ridges 12 of the outer sole. While walking or standing, foot pressure distributes forces dynamically along the area ranging from the center of the inner sole to its outlining periphery. The inner sole center area experiences an inwardly directed and downward force which is counter-acted by an outwardly directed force at the fused periphery junction of the inner/outer sole. In addition, a shoe upper 100 may be fused to inner sole 20 and outer sole 10. The forces due to the upper and the weight of the foot are complementary and oppose the inwardly directed downward force. The result is a stable shoe, with a defined and preserved underlying air cavity area 14.

There are numerous modifications in regard to the design and/or materials employed in FIGS. 1 through 4. For cold-weather shoe applications, dimensions of the FIG. 2 inner sole perforations and cutouts can be decreased accordingly.

Alternatively, the inner sole of FIG. 2 can be constructed out of an inherently breathable membrane material where gas exchange occurs through a tortuous path rather than through an intended cutout or perforation. For rainy-weather shoe applications, a "GORTEX-like" material is layered within the inner sole. Alternatively, the ventilation ports defined by the outer sole of FIG. 3 are covered and fused with a similar "gortex-like" material promoting air over liquid transpiration.

In accordance with another embodiment of the present invention, FIGS. 5, 5*a* and 5*b* illustrate a modified shoe combining properties of FIG. 3 and FIG. 4. To increase the structural rigidity of the inner sole and underlying air cavity area, two anvil-shaped supports 30 are placed at the ball and heel of the foot. The anvil supports are made of a lightweight rigid material and serve as a framework which preserves the shape of the open air cavity area under intense foot pressure. As shown in FIG. 5*b*, These anvil-shaped supports are perforated in a manner that extends and preserves the perforations of the inner sole. Consequently, the anvil perforations preserve the ventilation path to the air cavity areas without sacrificing necessary stability and rigidity. The upper portion of the front anvil is embedded to the inner sole and is shaped to conform to the ball of the foot. The anvil stem extends foot pressure to the lower anvil portion, which is embedded in the lower outer sole. This lower portion is slightly convex to facilitate the rolling or natural foot walking motion. The rear anvil is essentially similar in principle. Two ridges 32 provide support for the middle of the foot. This shoe has maximum heat and moisture expulsion into air cavity areas 34, 36, 38, and 40. Air cavity areas 34 and 36 are open to each other. Air cavity areas 40 and 42 are similarly open to each other.

Figure 6:
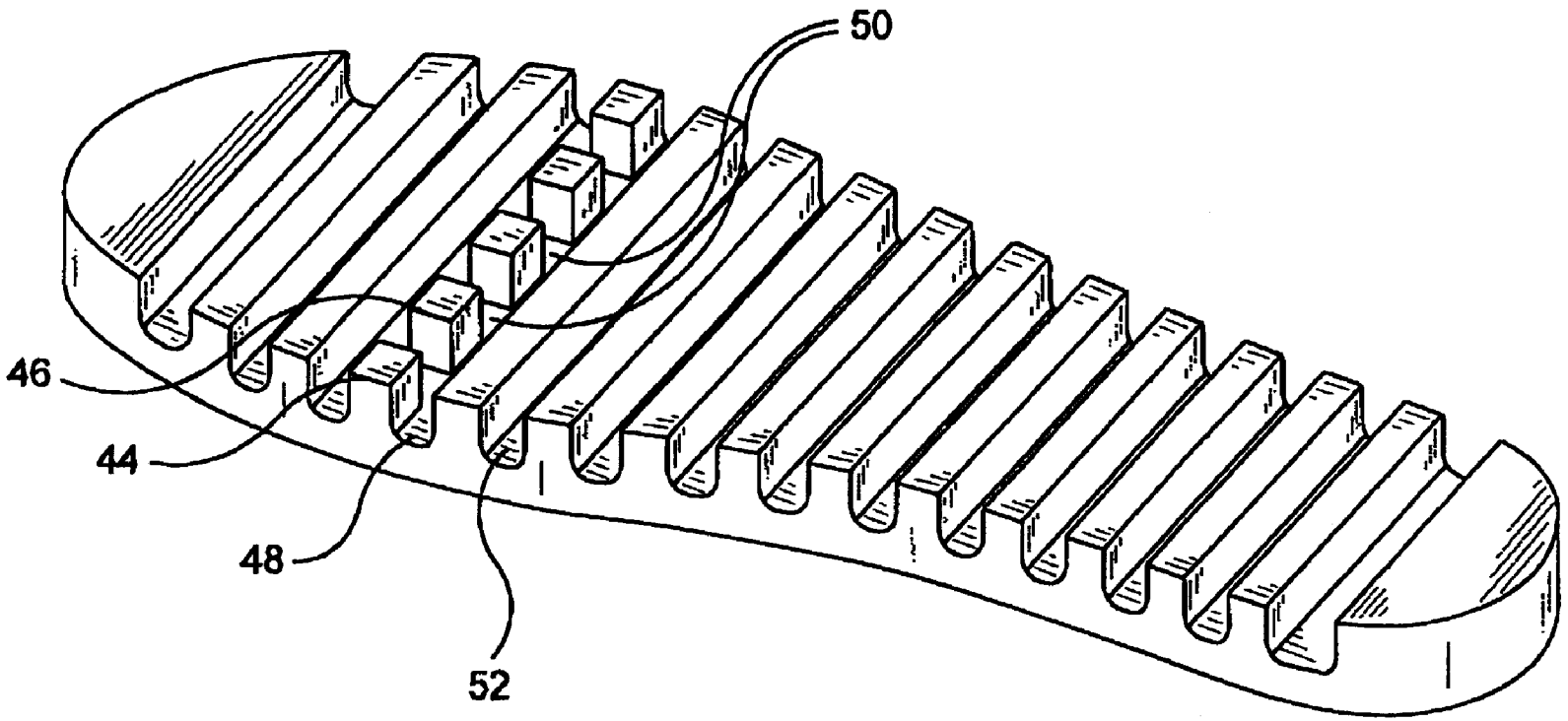
FIG. 6 shows a variation of FIG. 1, illustrating ridges and or columns extending across the outer sole.
Figure 7:
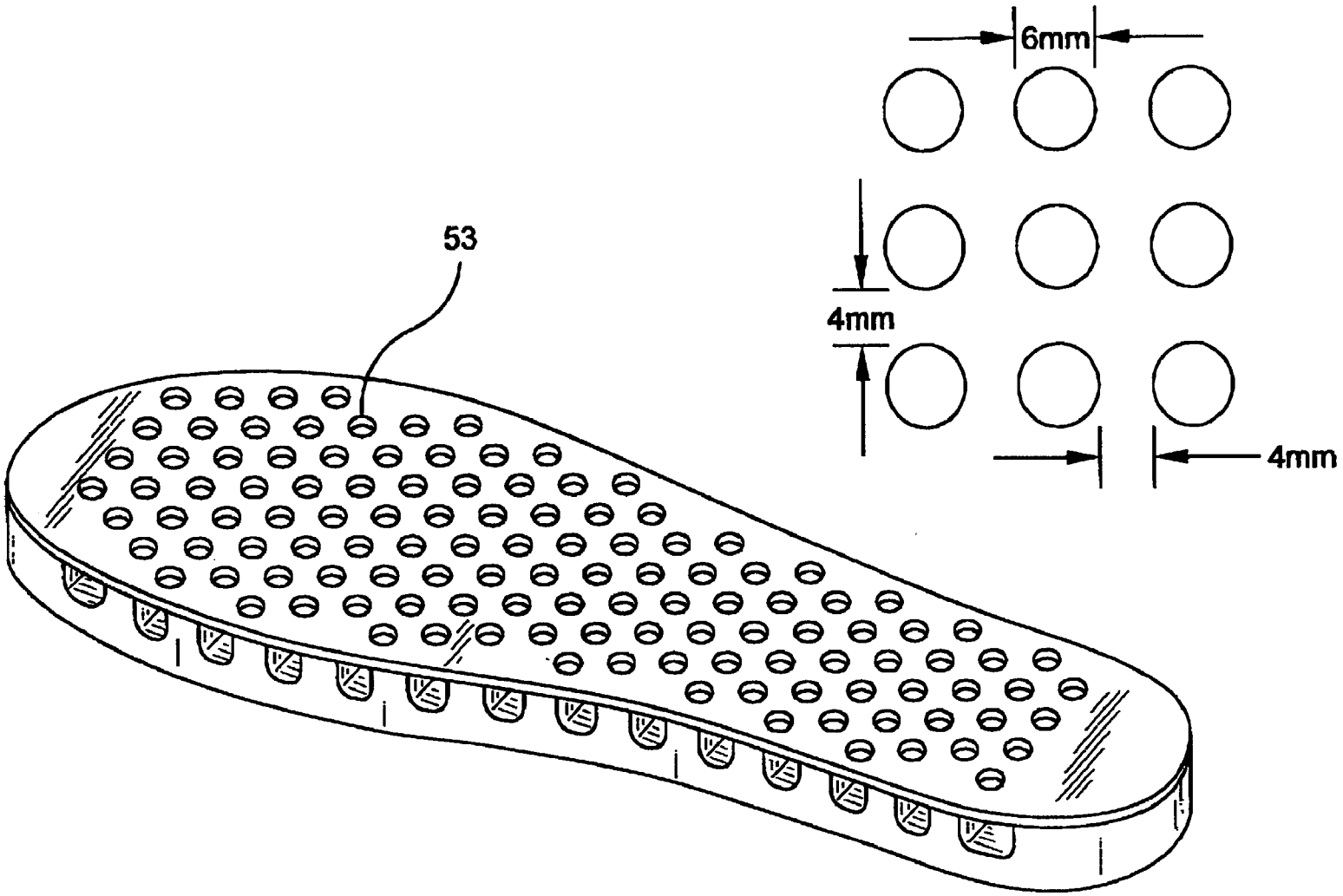
FIG. 7 shows a variation of the inner sole of FIG. 2, illustrating a plurality of perforations.

In accordance with another embodiment of the present invention, FIG. 6 is a variation of the outer sole of FIG. 1. Ridges 44 and/or columns 46 extend across the outer sole. The air cavity extends laterally 48 and longitudinally 50. Ventilation ports 52 exist throughout the periphery of the sole. This outer sole is made entirely of ridges, entirely of columns, or a combination of both. FIG. 7 is a variation of the inner sole of FIG. 2. This inner sole is perforated continuously with holes 53. Alternatively the inner sole utilizes a mesh or membrane material. In this embodiment, holes 53 have a diameter of 6 mm and are spaced 4 mm apart from other holes in a particular row. The rows of holes are also placed 4 mm apart. It is to be understood, however, that other dimensions may be utilized.

Figure 8:
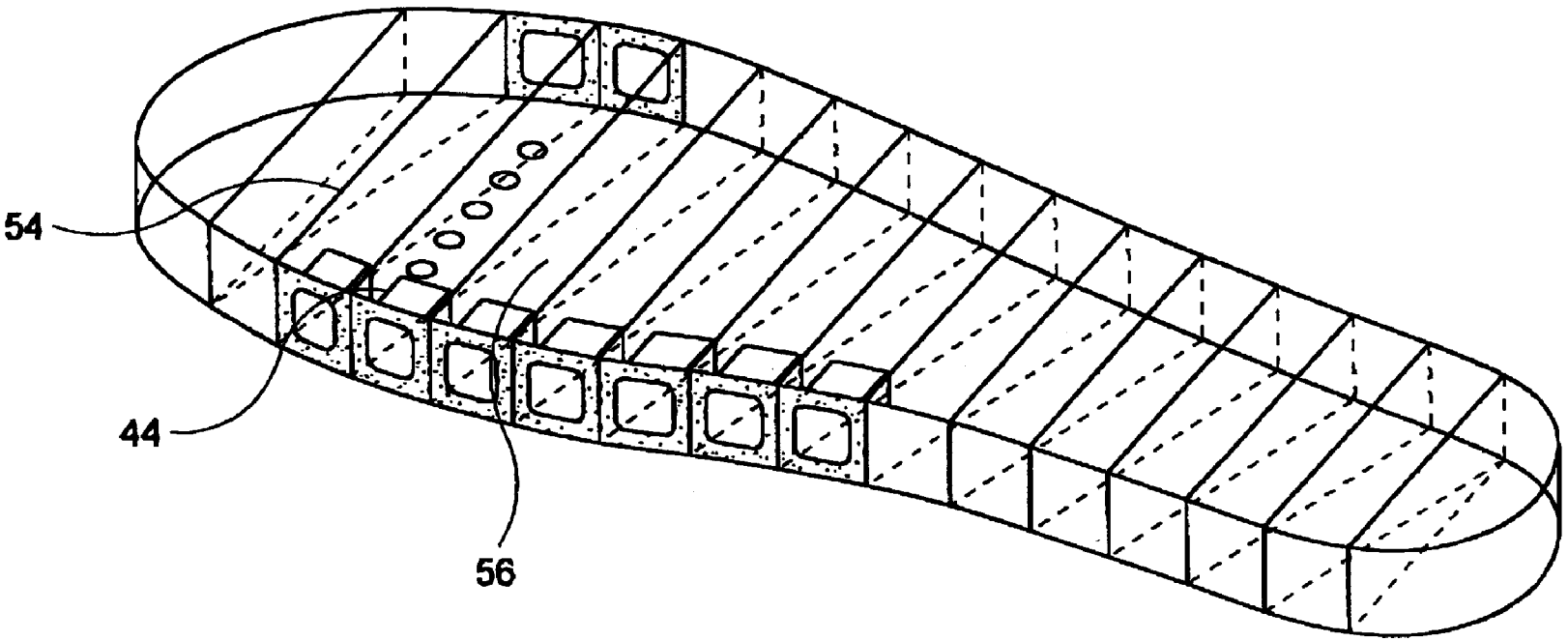
FIG. 8 shows an additional variation of FIG. 1, illustrating a spring-wrapped outer sole.

In accordance with another embodiment of the present invention, FIG. 8 is an additional variation of the outer sole of FIG. 1. This figure illustrates a "spring-wrapped" outer sole. This spring 54 is made of metal or plastic material. The spring provides support for the inner sole and serves to attach the inner and outer sole together. The spring outlines the air cavity area 56, which is a continuous open space under the inner sole.

Figure 9:
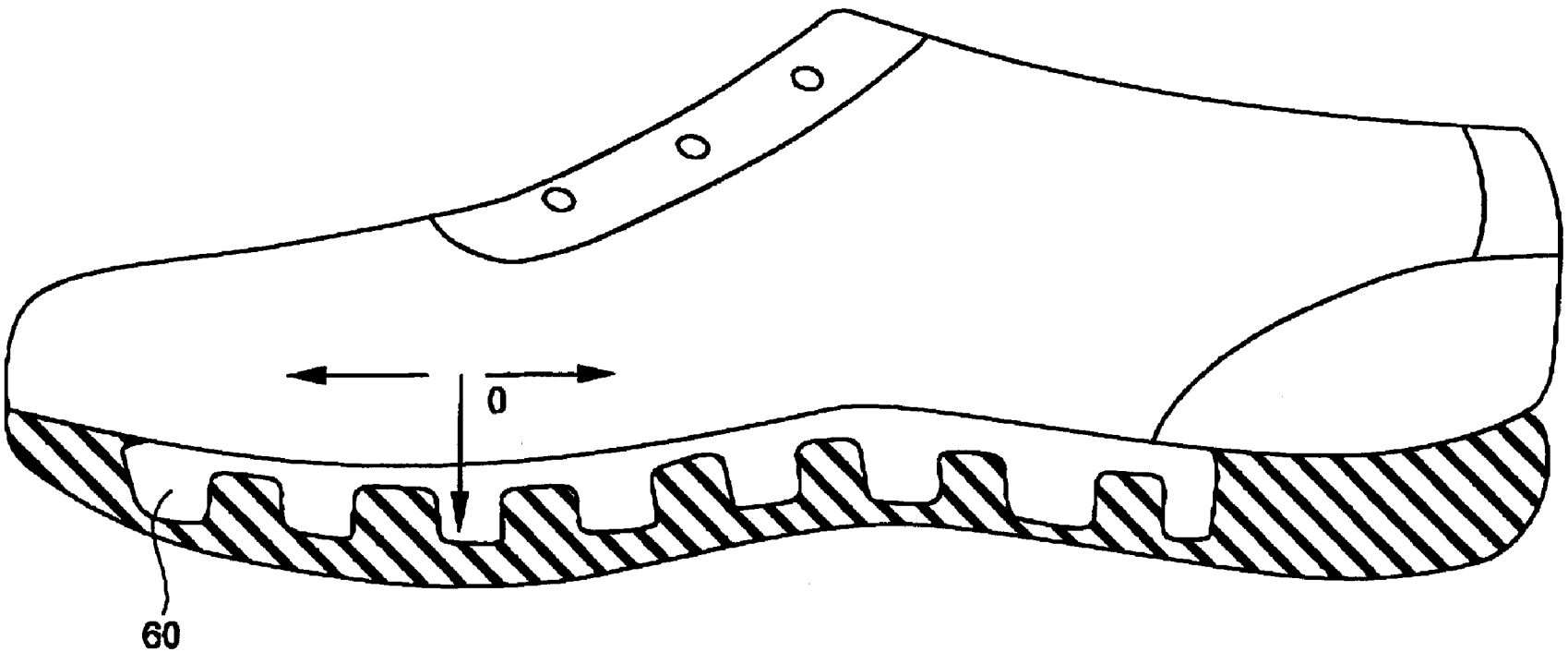
FIG. 9 shows an additional variation of FIG. 4 utilizing a free-floating outer sole.

In accordance with another embodiment of the present invention, FIG. 9 illustrates a "free-floating" system. It utilizes the ventilation properties of the previous inner and outer soles, but with an "energy-rebounding" 60 sole modification. The outer sole is fused to the inner sole at the heel and toe area. Between these areas the outer sole comes in contact with the inner sole during only the downstep cycle of the walking process. As the shoe is lifted, the outer sole releases from the inner. This momentarily increases the volume of the air cavity and ventilation port, which contributes to increased ventilation efficiency.

Although the description above contains many specificities, these should not be construed as limiting the scope of the invention but as merely providing illustrations of some of the presently preferred embodiments of the invention.

This the scope of the invention should be determined by the appended claims and their legal equivalents, rather than by the examples given.

What is claimed is:

1. An article of footwear having a ventilated sole system, comprising:

a dual-layer sole system having an inner sole and an outer sole, said inner and said outer sole having a length and a width, said inner sole and said outer sole being integrated together and forming an air-cavity therebetween, said air cavity being continuous and having an unobstructed area encompassing a majority of said width and said length of said outer sole for acting as an interfacing medium, said dual-layer sole system including a plurality of bi-directional ventilation ports, said bi-directional ventilation ports extending from said air-cavity to an area outside said article of footwear, wherein said inner sole of said dual-layer sole system is integrated with said outer sole through (a) a plurality of concave-shaped structural ridges that are concave in a direction parallel to air flow that passes through said bi-directional ventilation ports and said inner sole, (b) a heel member and (c) a toe member; wherein said concave-shaped structural ridges, said heel member and said toe member are disposed along a periphery of said air cavity as well as a periphery of said dual-layer sole system, and wherein said inner sole is made of a flexible but non-stretchable material.

2. The article of footwear of claim 1 wherein said dual-layer sole system further comprises a plurality of conduits extending from a surface on said inner sole which receives a user's foot through said inner sole into said air cavity.

3. The article of footwear of claim 2 wherein said plurality of concave-shaped structural ridges are fused to an underside of said inner sole in a manner which maintains conduit continuity into said air cavity.

4. The article of footwear of claim 3 wherein any two of said concave-shaped structural ridges border one of said plurality of bi-directional ventilation ports.

5. The article of footwear of claim 3 wherein said conduits are selected from the group consisting of perforations or cutouts.

6. The article of footwear of claim 3 wherein said structural ridges are disposed in said dual-layer sole system to provide structural rigidity to said dual-layer sole system to maintain air in said air cavity even when a user is standing on said dual-layer sole system to ensure that said air cavity maintains an air barrier interposed between a user's foot and a ground surface on which said article of footwear is placed to inhibit conduction of heat therebetween.

7. The article of footwear of claim 3 wherein said dual-layer sole system comprises an anvil support to enhance the structural rigidity of said dual-layer sole system.

8. The article of footwear of claim 7 wherein said anvil support is a first anvil support, said first anvil support disposed beneath a heel-region of said article of footwear, said dual-layer sole system further comprising a second anvil support disposed beneath a ball-region of said article of footwear.

9. The article of footwear of claim 8 wherein said first and second anvil supports contain perforations which extend and preserve the conduits of said inner sole.

10. The article of footwear of claim 3 wherein said inner sole is perforated from end to end with a plurality of holes.

11. The article of footwear of claim 1 wherein said outer sole comprises a spring-wrap system which provides support for said inner sole and serves to integrate said inner and outer soles together.

12. The article of footwear of claim 1 wherein said dual-layer sole system comprises an energy-rebounding free-floating sole construction in which the outer sole is fused to the inner sole at a heel area and at a toe area such that the outer sole comes in contact with the inner sole between said heel and toe areas only during a downstep cycle of a user's walking process.

13. An article of footwear having a ventilated sole system, comprising:

means for providing enhanced ventilation to a user's foot, said means comprising a dual-layer sole system including means for supporting a user's foot and means for engaging a ground surface upon which a user walks, said means for supporting a user's foot comprising an inner sole made of a flexible but non-stretchable material, said means for engaging comprising an outer sole, said inner and said outer sole having a length and a width, said inner sole being integrated with said outer sole to form therebetween an air cavity to provide ventilation to said user's foot, said air cavity being continuous and having an unobstructed area encompassing a majority of said width and said length of said outer sole for acting as an interfacing medium, said dual-layer sole system further comprising means for providing bi-directional air flow between said air cavity and an area outside said article of footwear, said dual-layer sole system further comprising means for ventilating said user's foot, said means for ventilating comprising a plurality of conduits, said means for ventilating extending from a surface on said inner sole through said inner sole into said air cavity; and means for enhancing structural rigidity of said dual-layer sole system, said means for enhancing structural rigidity comprising (a) concave-shaped ridges that are concave in a direction parallel to air flow that passes through said bi-directional means and said inner sole, (b) a heel portion and (c) a toe portion; wherein said concave-shaped ridges, said heel portion and said toe portion are disposed along a periphery of said air cavity, said means for enhancing structural rigidity being fused to said inner sole to maintain conduit continuity of said means for ventilating.

14. The article of footwear of claim 13 wherein said means for enhancing structural rigidity performs the additional function of providing sufficient structural rigidity to said dual-layer sole system to maintain air in said air cavity even when a user is standing on said dual-layer sole system to ensure that said air cavity maintains an air barrier interposed between a user's foot and a ground surface on which said article of footwear is placed to inhibit conduction of heat therebetween.

15. The article of footwear of claim 13 further comprising means for supporting said dual-layer sole system comprising a plurality of anvils contoured to a user's foot, said means for supporting said dual-layer sole system containing perforations which extend and preserve the conduits of said inner sole means.

16. The article of footwear of claim 15 further comprising means for supporting said inner sole and for integrating said inner sole to said outer sole said means for supporting and integrating comprising a spring-wrap system.

17. The article of footwear of claim 13 further comprising means for increasing ventilation efficiency by allowing the outer sole to contact said inner sole only during a downstep cycle of a user's walking process.

18. A method of supporting a foot of a user, comprising:

placing a center portion of the foot in direct contact with a flexible but non-stretchable inner sole while placing a peripheral portion of the foot to apply a force to outlying concave-shaped ridges of an outer sole; and applying foot pressure during ambulatory activity to said outer and inner sole to distribute force along an area ranging from a center of said inner sole to an outlining periphery of said inner sole, said application of foot pressure applying an inwardly directed force on said inner solo which is counter-acted by an outwardly directed force at a peripheral junction of said inner and outer soles, thereby preserving an air cavity underlying said flexible but non-stretchable inner sole.

19. The article of footwear of claim 2 further comprising a reinforcing member interconnecting two structural ridges disposed on opposite sides of said periphery of each air cavity.

20. The article of footwear of claim 1 wherein said air cavity extends from a heel portion to a toe portion, such that air within said air cavity and said bi-directional ventilation ports occupies a volume greater than the volume occupied by said concave-shaped structural ridges and said heel and toe portions.

21. An article of footwear having a ventilated sole system, comprising:

a dual-layer sole system having an inner sole and an outer sole, said inner and said outer sole having a length and a width, said inner sole made of a flexible but non-stretchable material, said inner sole and said outer sole being integrated together and forming an air-cavity therebetween, said air cavity being continuous and unimpeded from a heel portion to a toe portion of said article of footwear, wherein said heel portion and said toe portion are disposed along a periphery of said air cavity, said air cavity encompassing a majority of said width and said length of said outer sole for acting as an interfacing medium, said dual-layer sole system including a plurality of structural ridges disposed along a periphery of said air cavity, said dual-layer sole system further including a plurality of bi-directional ventilation ports, said structural ridges being concave in a direction parallel to air flow that passes through said bi-directional ventilation ports and said inner sole, said bi-directional ventilation ports extending from said air cavity to an area outside said article of footwear, wherein said air cavity and said plurality of bi-directional ventilation ports form a pumping chamber which occupies a substantial volume of said dual-layer sole system such that air is pumped into, and pushed out of, said dual-layer sole system when an individual walks on said article of footwear.

22. An article of footwear having a ventilated sole system, comprising:

a dual-layer sole system having an inner sole and an outer sole, said inner and said outer sole having a length and a width, said inner sole and said outer sole being integrated together and forming an air-cavity therebetween, said air cavity being continuous and having an unobstructed area encompassing a majority of said width and said length of said outer sole for acting as an interfacing medium, said dual-layer sole system including a plurality of bi-directional ventilation ports, said bi-directional ventilation ports extending from said air-cavity to an area outside said article of footwear, wherein said inner sole of said dual-layer sole system is integrated with said outer sole through (a) a plurality of concave-shaped structural ridges said structural ridges being concave in a direction parallel to air flow that passes through said bi-directional ventilation ports and said inner sole, (b) a heel member and (c) a toe member; wherein said concave-shaped structural ridges, said heel member and said toe member are disposed along a periphery of said air cavity as well as a periphery of said dual-layer sole system, and wherein said inner sole is made of a flexible but non-stretchable material, said inner sole further having at least one cutout and at least one perforation such that said cut out and said perforation provide a direct path for foot heat/moisture and air circulation.

* * * * *